United States Patent [19]

Kojima et al.

[11] Patent Number: 4,843,197

[45] Date of Patent: Jun. 27, 1989

[54] BUSH SWITCH AND METHOD OF PRODUCTION THEREOF

[75] Inventors: Hisano Kojima, Amagasaki; Michio Hirabayashi, Ibaraki, both of Japan

[73] Assignee: Idec Izumi Corporation, Osaka, Japan

[21] Appl. No.: 113,026

[22] Filed: Oct. 27, 1987

[30] Foreign Application Priority Data

Oct. 31, 1986 [JP] Japan ..... 61-260958
Oct. 31, 1986 [JP] Japan ..... 61-260959

[51] Int. Cl.[4] ..... H01H 5/30

[52] U.S. Cl. ..... 200/406; 200/302.2; 200/516

[58] Field of Search ..... 200/305, 306, 302.2, 200/159 B, 76, 406, 515, 516

[56] References Cited

U.S. PATENT DOCUMENTS 2,262,777 11/1941 Roper ..... 200/534
3,769,869 11/1973 Nelson, Jr. ..... 200/305
3,995,126 11/1976 Larson ..... 200/515 X
4,018,999 4/1977 Robinson et al. ..... 200/302.2
4,703,139 10/1987 Dunlap ..... 200/406
4,803,321 2/1989 Lefebvre ..... 200/517

FOREIGN PATENT DOCUMENTS 56-43573 10/1981 Japan .
8602196 4/1986 PCT Int'l Appl. ..... 200/302.2

*Primary Examiner*—Renee S. Luebke

[57] ABSTRACT

A push switch includes a central contact member arranged on a contact support member with an annular peripheral contact member surrounding the central contact member. An elastic conductive member such as a belleville spring and the peripheral contact member along their entire outer edge portions are fixedly held within an insulating case in a manner to seal the space around the central contact. In addition, an elastic spring member may be provided in a position covering the elastic conductive member. A plurality of the push switches may easily be manufactured on an assembly line by forming a multiplicity of central contacts, peripheral contacts and conductive members in separate processes and sequentially going through a first and second insert molding processes.

7 Claims, 18 Drawing Sheets

BUSH SWITCH AND METHOD OF PRODUCTION THEREOF

BACKGROUND OF THE INVENTION

1. Field of the Invention

The present invention relates to a miniature push switch packaged on a substrate to be turned on/off by the reversing action of a belleville spring, and a method of producing the same.

2. Description of the Related Art

It is desirable that a push switch packaged on a substrate is small in size and low in cost, and at the same time, have an accurate contact condition, a high operability and durability. To meet these requirements, a conventional push switch, as shown in FIG. 24, comprises a central contact 202 and a peripheral contact 203 making up a conducting circuit securely fixed to an insulating case 201, and a belleville spring 204 upwardly covex in contact with the peripheral contact 203 along the outer edges thereof. Further, such a push switch comprises an actuator 205 formed with a protrusion 205*a* in contact with the top of the belleville spring 204. When the actuator 205 is pressed from the upside, the protrusion 205*a* pushes the belleville spring 204 downwardly, so that the interior surface of the central part of the belleville spring 204 comes into contact with the central contact 202. As a result, the central contact 202 is electrically connected to the peripheral contact 203 through the belleville spring 204.

In a conventional method of fabricating the above-described push switch, as for example disclosed in JP-B-56-43573, a multiplicity of conducting circuits, each including a pair of central and peripheral contacts, are coupled in a sequence, and a multiplicity of mounts for holding the conducting circuits are insert-molded, after which a push spring (belleville spring) is placed in a recess of each mount.

In this conventional push switch, the belleville spring is movable horizontally in a case or mount, and it is impossible to maintain secure contact with the peripheral contact. Also, for the same reason, the peripheral contact is exposed to the atmosphere, often causing a contact failure due to intrusion of dust, etc. Further, if the push switch is washed with water after being packaged in the substrate, moisture penetrates, thereby hampering automation of the work of substrate assembly. If the thickness of the belleville spring is increased in order to improve the sensitivity of the operation of the switch, the internal stress required for elastic deformation is increased, with the result that the push switch is easily damaged by repetitive fatigue, thereby leading to a lower durability. In addition, it is necessary to mount the belleville spring, an operating button for pushing down the spring and a cover serving as a protective member in different processes, thus complicating the fabrication processes.

SUMMARY OF THE INVENTION

A first object of the present invention is to provide a push switch comprising a case of double structure including inside and outside members, a peripheral contact shielded from outside by the outside member and a belleville spring to prevent foreign matters from intruding the boundary between the peripheral contact and the outer edge of the belleville spring, so as to secure a switch with good contact condition, dust-proof and waterproof. Such structure allows automation of substrate production, while at the same time improving the durability and operability of the switch.

A second object of the present invention is to provide a push switch in which the contact condition of a conduction circuit is kept satisfactory, and the elastic members such as the belleville spring and the operating buttons are internally mounted to attain a reduced size and thickness and an improved operability.

A third object of the present invention is to provide a method of fabrication a push switch easily and efficiently by two successive insert molding processes to hold the central contact, the peripheral contact and the belleville spring in a double structure.

A fourth object of the present invention is to provide a method of fabricating a push switch easily and efficiently in which the parts and protective members making up a conducting circuit are coupled individually in a sequence and by two successive processes of insert molding, the parts are held in a double structure.

In order to achieve the above-mentioned first object, there is provided according to the present invention a push switch comprising a central contact and a peripheral contact making up a conducting circuit, a conductive belleville spring having an outer edge in contact with the peripheral contact, and an insulating contact support member for supporting the central contact and the peripheral contact, wherein the peripheral contact is an annular contact surrounding the whole outer periphery of the central contact, the push switch further comprising an insulating case in close contact with the outside of the contact support member to fixedly secure the outer edge of the belleville spring and the peripheral contact between itself and the top of the contact support member.

In this push switch, the whole periphery of the outer edge of the belleville spring is fixedly secured to the whole periphery of the annular peripheral contact by the case. As a result, the portion between the top of the contact support member and the inner side of the belleville spring is completely sealed from outside to shield the central contact successfully from the outside environment.

In order to achieve the above-mentioned second object, there is provided according to the present invention a push switch comprising a central contact and a peripheral contact surrounding the whole outer periphery of the central contact making up a conducting circuit, a contact support member for supporting the central contact and the peripheral contact, a conductive thin plate with an outer edge in normal contact with the peripheral contact and a central part elastic enough to be contactable with the central contact, an elastic spring member for fixedly securing an insulating operating button located on the top of the central part of the thin conductive plate, and an insulating case mounted in close contact with the outer side of the contact support member for fixedly securing the outer edges of the spring member, the thin conductive plate and the peripheral contact between the case and the top of the contact support member.

In this push switch, elasticity is generated by the spring member and the conductive thin plate, and thus the elastic properties are improved while at the same time providing a high operability and extending the service life of the contacts.

In order to achieve the third object mentioned above, there is provided according to the present invention a method of fabricating a push switch comprising the steps of coupling, sequentially but separately, a multiplicity of central contacts, a plurality of peripheral contacts each adapted to surround the whole periphery of each central contact, and a plurality of belleville springs each adapted for contact with the whole outer periphery of each peripheral contact, molding a plurality of contact support members for the central contact by a first insert molding process, placing each peripheral contact and each belleville spring separately or integrally on the top of the contact support member, and molding by a second insert molding process a multiplicity of cases each in close contact with the outer side of each of the contact support member for fixedly holding the peripheral contact and the belleville spring between the case and the top of the contact support member. In the method of fabricating a push switch mentioned above, the central contact is supported by the contact support member made by the first insert molding. Also, the peripheral contact and the belleville spring are fixedly secured between the case and the top of the contact support member by the case prepared by the second insert molding process. These two insert molding processes are carried out successively.

In order to achieve the fourth object of the present invention, there is provided a method of fabricating a push switch comprising the steps of coupling, in sequence, but separately, a plurality of central contacts, a plurality of peripheral contacts each adapted to surround the whole outer edge proton of each central contact, a plurality of thin conductive plates each with an outer edge adapted for contact with the peripheral contact and a plurality of spring members each having an insulating operating button adapted for contact with the thin conductive plate, molding a plurality of annular members of an insulating material each adapted for contact with the operating button and the thin conductive plate at the central part and the outer edge respectively of the spring member, preparing by a first insert molding a contact support for each central contact, placing the peripheral contact and the thin conductive plate on the top of the contact support in contact with the outer edge or the contact support, placing the spring member with only the annular member in contact with the peripheral contact or the thin conductive plate, and preparing by a second insert molding a case in close contact with the outer side of the contact support member for fixedly securing the peripheral contact, the thin conductive plate and the spring member between the case and the top of the contact support member.

DESCRIPTION OF THE PREFERRED EMBODIMENTS

Figure 1:
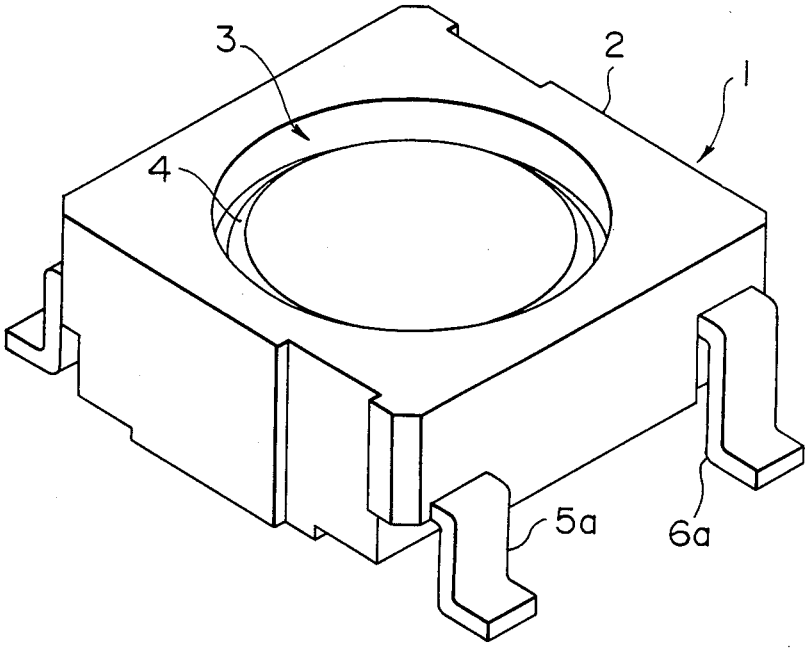
FIG. 1 is a perspective view of a push switch according to an embodiment of the present invention.

An embodiment of the present invention will be explained in detail below with reference to the drawings.

A push switch 1 is formed in outline of a case 2 made of an insulating resin material. An aperture 3 is formed in the top of this case 2. A protruded belleville spring 4 is exposed above the aperture 3. A central contact terminal 5a and a peripheral contact terminal 6a are exposed outwardly of the side of the case 2.

Figure 2A:
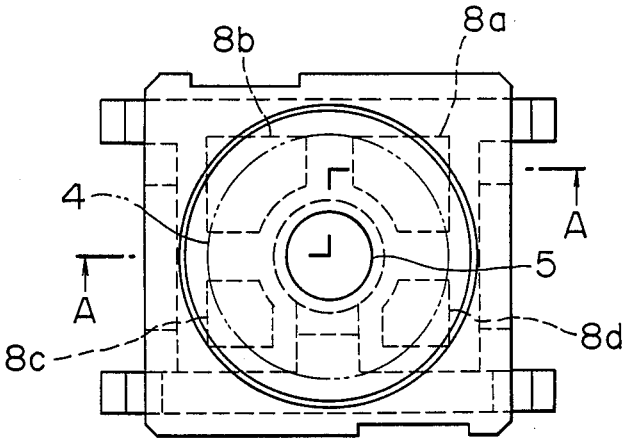
FIG. 2A is a top plan view of the push switch shown in FIG. 1.
Figure 2B:
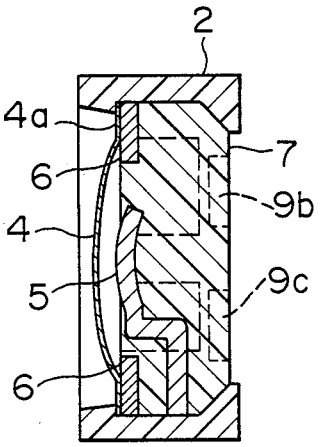
FIG. 2B is a side sectional view of the push switch shown in FIG. 1.
Figure 2C:
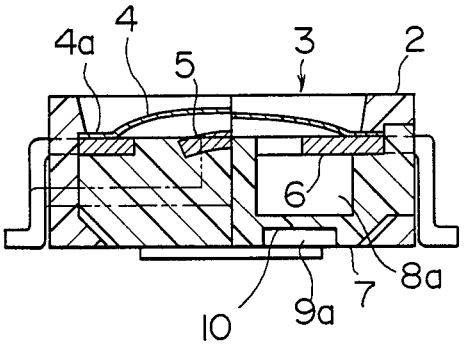
FIG. 2C is a frontal step sectional view of the same push switch taken along the line A—A in FIG. 2A.

As shown in FIGS. 2B and 2C, the case 2 contains a contact support member 7 of an insulating resin material. The contact support member 7 has supported therein a central contact 5 of a conductive metal material. A peripheral contact 6 of a conductive metal material is placed on the top of the contact support member 7. Further, an outer edge portion 4a of the belleville spring 4 is positioned in contact with the top of the peripheral contact 6. The belleville spring 4 is formed in a protrusion by pressing a thin plate of a conductive metal material such that the protrusion has an elastic characteristic.

Figure 3:
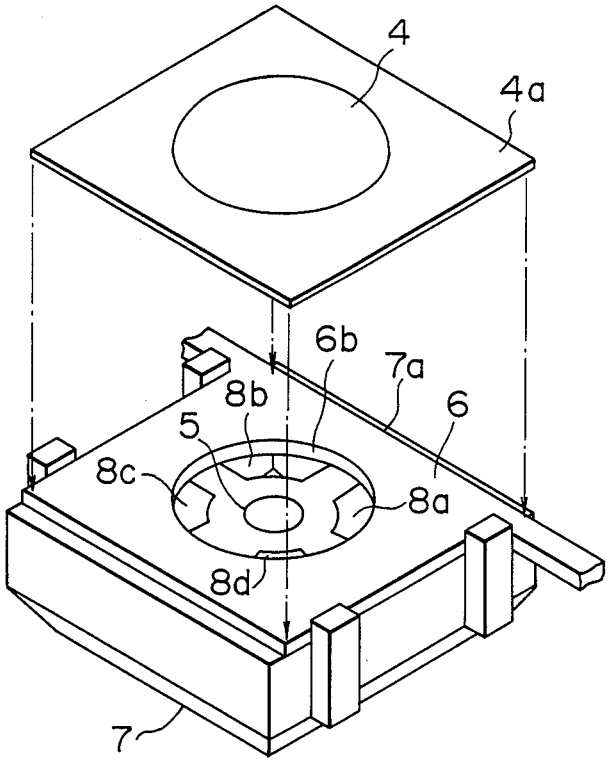
FIG. 3 is an exploded perspective view of the essential parts of the push switch.

As shown in FIG. 3, a part of the central contact 5 is exposed at the central part of the top 7a of the contact support member 7. The central part of the peripheral contact 6 is provided with an aperture 6b, at the center of which the central contact 5 is located. Specifically, the peripheral contact 6 is formed with an annular shape surrounding the whole periphery of the central contact. The outer edge portion 4a is arranged in contact with the whole periphery of the aperture 6b on the top of the peripheral contact 6.

Recesses 8a to 8d, opened to the top 7a are formed in the contact support member 7. Also, the bottom of the contact support member 7 is provided with holes 9a to 9d (the hole 9d not shown). These holes 9a to 9d are formed at the time of the first insert molding. The holes 9a to 9d are formed in opposed relations with the recesses 8a to 8d respectively, with the bottom 10 of the recesses 8a to 8d thinned appropriately.

Figure 4:
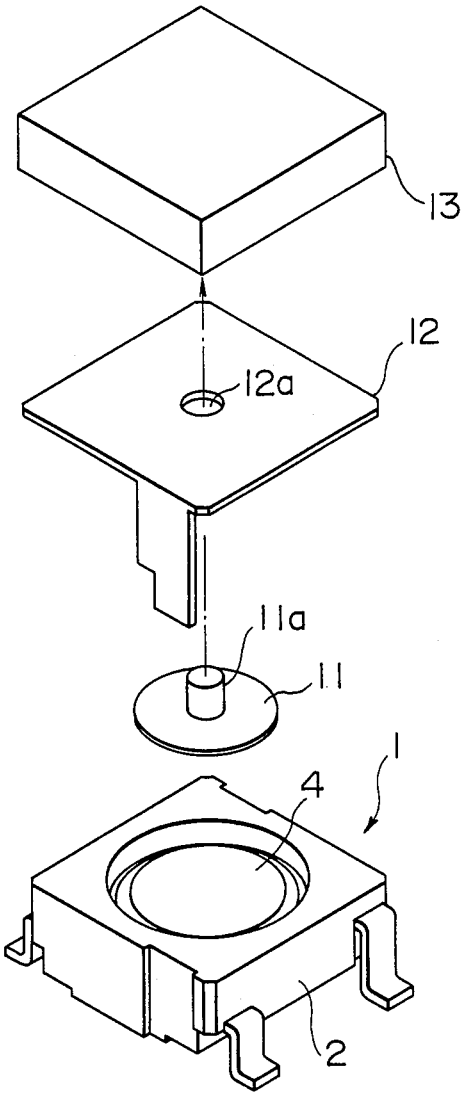
FIG. 4 is an exploded perspective view of the push switch.

As shown in FIG. 4, the push switch 1 has an actuator 11 disposed upward of the belleville spring 4 and a cover 12 set up on the top of the case 2. Under this condition, the protrusion 11a of the actuator 11 is exposed upward of the cover 12 from the hole 12a of the cover 12. The protrusion 11a thus exposed from the cover 12 has mounted an operating button 13 thereon. The operating button 13 and the actuator 11 are formed of an insulating resin material.

When the operating button 13 is pressed from upside, the actuator 11 moves downwardly, thus causing the lower side of the actuator 11 to press the top of the belleville spring 4. As a result, the inner side of the belleville spring 4 through an elastic deformation protrudes downwardly. In the process, the inner side of the belleville spring 4 is brought into contact with the central contact 5, so that the central contact 5 is electrically connected to the peripheral contact 6. When the operating button 13 is released from pressure, the belleville spring 4 is restored to an upwardly protruded form by elasticity thereof, and the inner side of the belleville spring 4 fails to contact the central contact 5.

According to this embodiment, the whole periphery of the outer edge portion 4a of the belleville spring 4 is in contact with the top of the peripheral contact 6. The outer edge portion 4a of the belleville spring 4 and the peripheral contact 6, which are fixed between the top of the contact support member 7 and the case 2, are always kept in satisfactory contact with each other. For the same reason, the inner side of the belleville spring 4 is completely sealed from outside. As a consequence, moisture or dust from outside are prevented from entering, and the same conductive state as the initial state is maintained when the inner state of the belleville spring 4 is in contact with the central contact 5, keeping service life of the push switch very long. Further, the recesses 8a to 8d formed in the contact support 7 provide a sufficient space under the belleville spring 4. As a result, the increase in internal pressure is reduced when the belleville spring 4 is pressed from upside. This effect is made even more conspicuous by thinning and providing a bottom 10 with elasticity. By these means, it is possible to reduce the pressure of the belleville spring 4 for an improved click feeling and operability. Although the belleville spring 4 is disposed above the peripheral contact 6 in the above-mentioned embodiment, it may alternatively be positioned below the peripheral contact 6 with the outer edge portion thereof in contact with the bottom of the peripheral contact 6.

Now, a method of fabricating the push switch described above will be briefly explained As shown in FIG. 5, a plurality of central contacts 5, peripheral contacts 6 and belleville springs 4 are coupled sequentially by separate press processes. In the production line, the central contacts 5 and the peripheral contacts 6 are fed at the same rate in the same direction indicated by arrow L in FIG. 5, while the belleville springs 4 are carried in the direction indicated by arrow M perpendicular to the direction of arrow L. In this production line, first, the central contact 5 is subjected to a first insert molding by a first insert molder 21 thereby to form a contact support member 7. In the process, a part of the central contact 5 is exposed above the contact support member 7.

Then, the peripheral contact 6 is disposed on the top of the contact support member 7 and the belleville spring 4 on the top of the peripheral contact 6. In this way, a second insert molding process is effected in such a position where the contact support member 7, the peripheral contact 6 and the belleville spring 4 are integrated with each other, thus forming a case 2. The second insert molder 31 is provided with a cutter not shown to cut the coupler of the belleville spring 4 upon molding of the case 2. The case 2 holding therein the contact support member 7 supporting the central contact 5 therein, the peripheral contact 6 and the belleville spring 4 is fed in the direction indicated by arrow L. Subsequently, the couplers of the central contact 5 and the peripheral contact 6 are formed into respective terminals.

The first insert molding process will be explained in more detail.

Figure 6A:
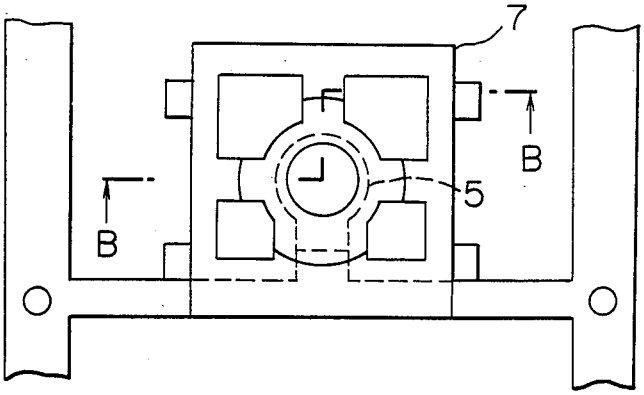
FIG. 6A is a plan view of a contact support prepared by a first insert molding process.
Figure 6B:
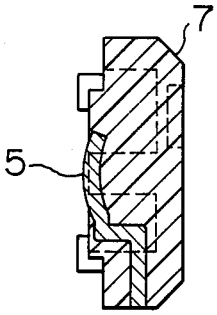
FIG. 6B is a side sectional view of the contact support shown in FIG. 6A.
Figure 6C:
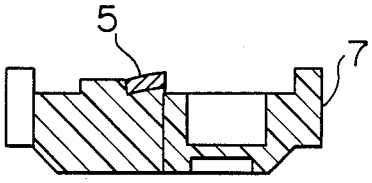
FIG. 6C is a frontal step sectional view taken along the line B—B of the contact support in FIG. 6A.
Figure 6D:
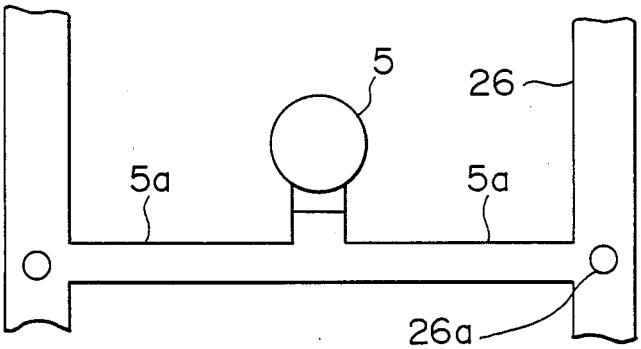
FIG. 6D is a plan view of a central contact involved in the first insert molding.
Figure 7:
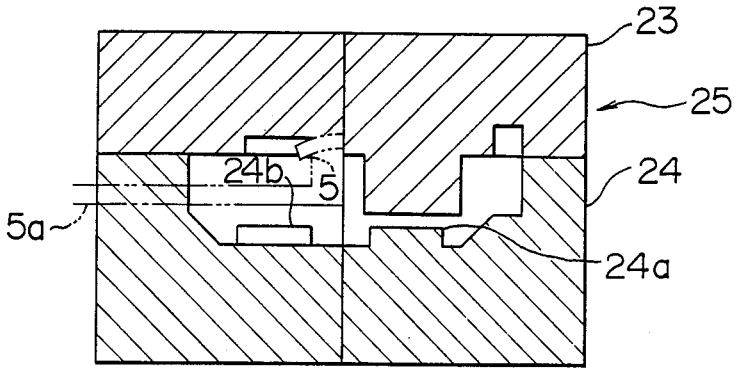
FIG. 7 is a step sectional view of a die used for the first insert molding process.

As shown in FIG. 6D, a plurality of central contrasts 5 are formed in a sequence and supported on guides 26 through couplers 5a. The guides 26 have pinholes 26a formed therein equidistantly for fitting on pins formed along the peripheral part of rollers while being fed in a production line. The first insert molding is effected on each of the central contacts 5 fed on the production line, and a contact support member shown in FIGS. 6A, 6B and 6C is molded by a die shown in FIG. 7. The die 25 is divided into an upper die unit 23 and a lower die unit 24 at the time of insert molding and has the central contact 5 held therein. A space shown in FIG. 7 is formed in the die 25 with the upper die unit 23 and the lower die unit 24 integrated with each other. This space is supplied with resin from a supply unit not shown. In the process, a part of the central contact 5 is kept in contact with the recess of the upper die 23 to keep off resin. A part of the central contact 5 is therefore exposed above the contact support member 7 thus formed.

The second insert molding process will be explained in more detail.

The second insert molding process is effected with the peripheral contact 6 and the belleville spring 4 placed on the top of the contact support member 7 prepared by the first insert molding. The peripheral contact 6 is held on a guide 32 through a coupler 6*a*, so that a plurality of peripheral contacts 6 are formed in sequence. A plurality of pinholes 32*a* are formed in the guide 32 to fit on pins formed along the peripheral side of rollers while being fed. The belleville spring 4 is held on the guide 36 through the coupler 4*a*, and the under this condition, a multiplicity of belleville springs 4 are formed in sequence and equidistantly. A plurality of pinholes 36*a* are formed in the guide 36 and adapted to be fitted on pins formed along the peripheral part of rollers while being fed.

Figure 10:
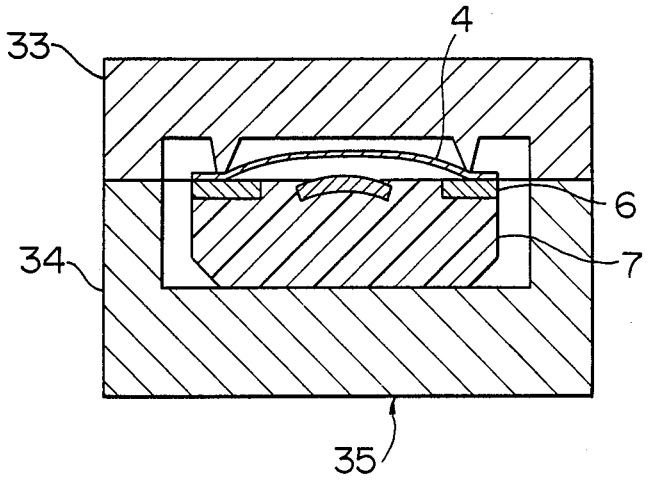
FIG. 10 is a front sectional view of a die used for the second insert molding process.

The die 35 is divided into an upper die unit 33 and a lower die unit 34 at the time of the second insert molding, and has the contact support member 7, the peripheral contact 6 and the belleville spring 4 held therein. Under this condition, when the upper die unit 33 and the lower die unit 34 are integrated with each other, a space is formed as shown in FIG. 10. This space is supplied with resin from supply means not shown. A case 2 shown in FIGS. 2A, 2B and 2C is thus formed. The die 35 also includes a cutter not shown to cut the coupler 4*a* of the belleville spring 4 when the upper die unit 33 and the lower die unit 34 are integrated.

As described above, according to the present embodiment, insert molding processes are effected twice successively in a production line to resin mold the contact support member 7 and the case 2 respectively. As an alternative method, the peripheral contacts 6 and belleville springs 4 formed in sequence may be integrated by spot welding and set on the contact support members 7 at the time of the second insert molding process. In addition, the coupler 4*a* of the belleville spring 4 may be cut at the same time. Also, if the protrusions 24*a* and 24*b* of the lower die unit 24 of the die 25 used for the first insert molding are configured of pins whose height is adjustable, it is possible to change the thickness of the bottom 10 of the recesses 8*a* to 8*d* of the contact support member 7, thereby permitting the pressure and the operating feeling of the belleville spring 4 to be adjusted.

Another form of push switch according to the present invention will be explained below.

Figure 11:
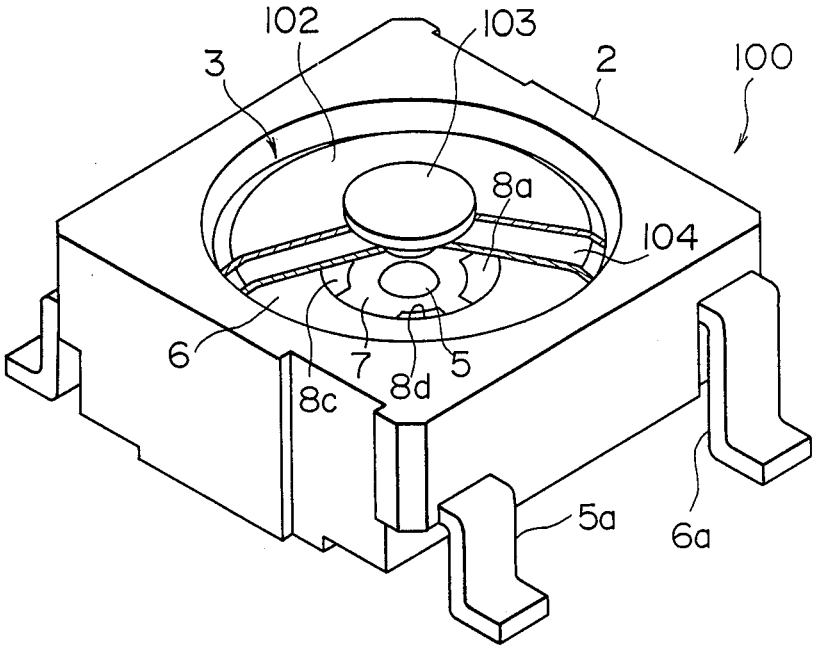
FIG. 11 is a perspective view of a partially-cutaway appearance of a push switch according to another embodiment of the present invention.

The same part of the above description of the push switch 1 will be omitted and component elements identical to those of the push switch 1 will not be described again. In FIG. 11, a push switch 100 comprises a case 2 forming an outline thereof and having an aperture 3 formed at the central part of the top thereof. A spring member 102 is arranged in the aperture 3. The spring member 102 is pressed into an upwardly projecting form of belleville spring, and has an operating button 103 of an insulating resin material fixedly secured at the central part thereof. The case 2 includes therein a contact support member 7, a central contact 5, a terminal 5a thereof, a peripheral contact 6, and a terminal 6*a* thereof are configured in the same manner as the corresponding parts of the push switch 1 described above. Numeral 104 designates a thin conductive plate formed by pressing into the form of a belleville spring with an upward protrusion, which spring corresponds to the belleville spring 4. The top of the thin conductive plate 104 is kept in contact with the protrusion formed in the bottom of the operating button 103. The button of the outer edge portion of the spring member 102 is formed with an insulating annular member 105 along the whole peripheral part thereof, and the bottom of the annular member 105 is in contact with the top of the outer edge portion of the thin conductive plate 104.

The case 2 is arranged in close contact with the side of the contact support member 7 on the one hand and fixedly secures the peripheral contact 6, thin conductive plate 104 and the spring member 102 along the whole peripheral parts thereof between the case 2 and the contact support member 7 on the other.

Figure 12A:
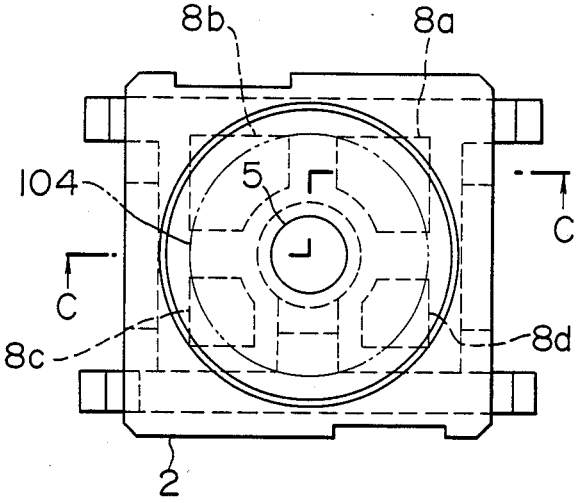
FIG. 12A is a plan view of the push switch shown in FIG. 11.
Figure 12B:
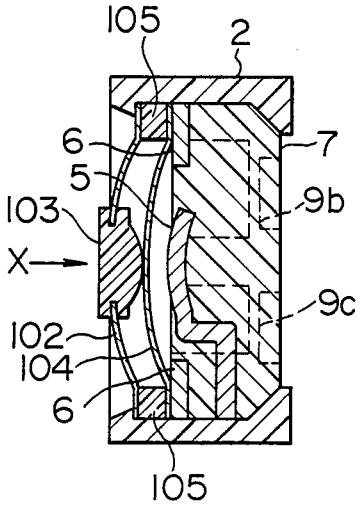
FIG. 12B is a side sectional view of the push switch.
Figure 12C:
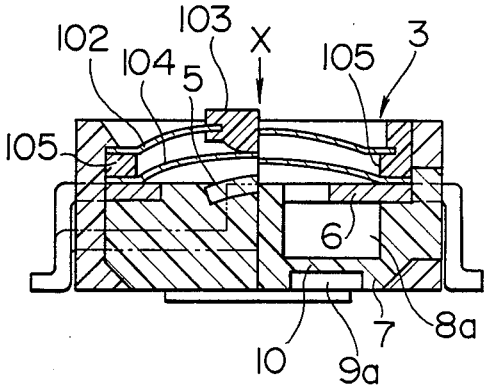
FIG. 12C is a frontal stop sectional view of the push switch taken along the line C—C in FIG. 12A.

When the operating button 103 is pressed in the direction of arrow X in FIGS. 12B and 12C, the protrusion of the spring member 102 is elastically deformed downward in protruded form. On the other hand, the bottom of the operating button 103 comes into contact with the thin conductive plate 104 whereby pressure is exerted to develop an elastic deformation of a downward protrusion. As a result, the central part of the bottom surface of the thin conductive plate 104 comes into contact with a part of the central contact 5. In view of the fact that the outer edge portion of the thin conductive plate 104 is in normal contact with the peripheral contact 6, the contact between the thin conductive plate 104 and the central contact 5 connects the peripheral contact 6 and the central contact 5 electrically.

When pressure in the direction of arrow X ceases to be exerted on the operating button 103, the thin conductive plate 104 and the spring member 102 restore an upwardly protruded form by respective elasticity. In the process, the thin conductive plate 104 ceases to contact the central contact 5, so that the peripheral contact 6 and the central contact 5 are electrically disconnected. As explained above, in turning on the push switch 100, the operating button 103 is pressed in the direction of arrow X, while in turning off the push switch 100, the pressure on the operating button 103 is released. The pressure exerted on the operating button 103 is sufficiently large to cause an elastic deformation of the spring member 102 and the thin conductive plate 104. Also, at the time of restoration, the sum of elastic forces of the spring member 102 and the thin conductive plate 104 is exerted on the operating button 103.

The pressure exerted on the operating button 103 acts on both the spring member 102 and the thin conductive plate 104, and therefore, if the elastic force of the spring member 102 is sufficiently large, the elastic force required of the thin conductive plate 104 may be reduced. Specifically, the internal stress of the thin conductive plate 104 can be reduced, thereby making it possible to reduce the metal fatigue under repetitive stress. It is thus possible to increase the durability of the thin conductive plate 104.

Further, the downwardly convex elastic deformation of the thin conductive plate 104 reduces the volume of the lower side of the thin conductive plate 104. In view of the fact that the amount of reduction in the elastic deformation of the thin conductive plate 104 is very small as compared with the volume of the recesses 8*a* to 8*d* formed in the contact support member 7, therefore, the internal pressure increases only slightly. In addition, the bottom 10 of the recesses 8*a* to 8*d* is thin enough due to the holes 9*a* to 9*d* and thus has a sufficient elasticity. As a result, when the operating button 103 is pressed, no substantial force is exerted other than the elastic force of the spring member 102 and the thin conductive plate 104 and therefore the operating feeling is not adversely affected.

The whole outer edge of the spring member 102 is fixedly secured in close contact with the case 2 thereby sealing the thin conductive plate 104, the central contact 5 and the peripheral contact 6 completely. Specifically, the spring member 102 functions as a cover of the contacts. For this reason, such foreign matters as dust are prevented from entering, thus preventing any contact failure. Also, solder flux or washing water does not penetrate the substrate under production, and therefore the substrate assembly work is easier to automate.

If the outer surface of the spring member 102 is covered by a heat-resistive film such as polyimide, on the other hand, solder is prevented from attaching in the dip soldering of the substrate.

Figure 13:
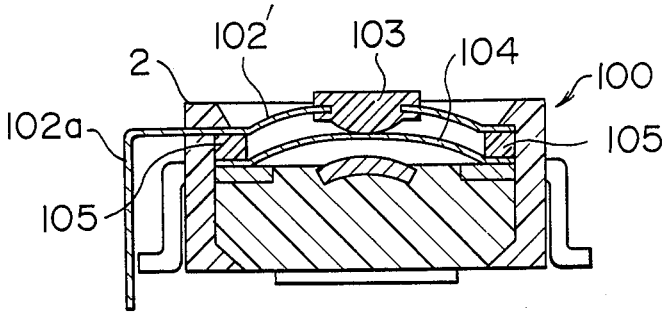
FIG. 13 is a front sectional view of a push switch according to another embodiment.

FIG. 13 shows a push switch according to another embodiment of the present invention. As shown in FIG. 13, a spring member 102' is formed of a conductive material, and a part of the outer edge thereof is exposed out of the case 2 as a grounding terminal 102*a*. By this configuration, the spring member 102' may be used as a shield member when the push switch 100 is packaged in a substrate, thus eliminating the need of mounting other members.

Figure 14A:
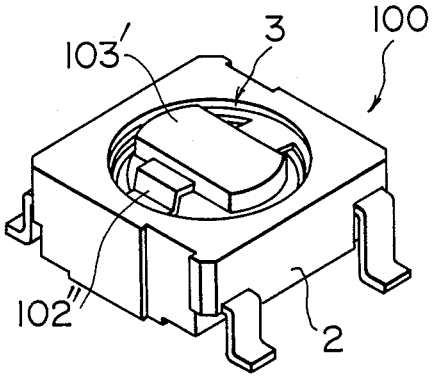
FIG. 14A is a perspective view of the appearance of a push switch according to still another embodiment of the invention.
Figure 14B:
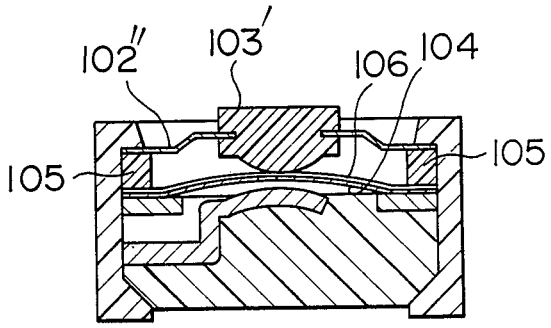
FIG. 14B is a side sectional view of the push switch shown in FIG. 14A, FIGS. 15A and 15B are a plan view and a side sectional view respectively of a thin conductive plate according to a further embodiment.

FIGS. 14A and 14B show still another embodiment of the present invention.

A spring member 102" arranged in the aperture 3 of the case 2 is formed in a spring plate upwardly protruded with an operating button 103'. This construction with the spring member 102" formed in a spring plate is easier to fabricate than a belleville spring and therefore the production cost thereof is lower. In this case, the thin conductive plate 104 is exposed outside. If this condition is left as it is, however, solder would attach to the thin conductive plate 104 during the dip soldering work of the substrate, thereby causing a problem of elasticity loss adversely affecting the switch operation. The eliminate this, the outer surface of the thin conductive plate 104 is covered by a heat resistive film 106 such as polyimide.

Figure 15A:
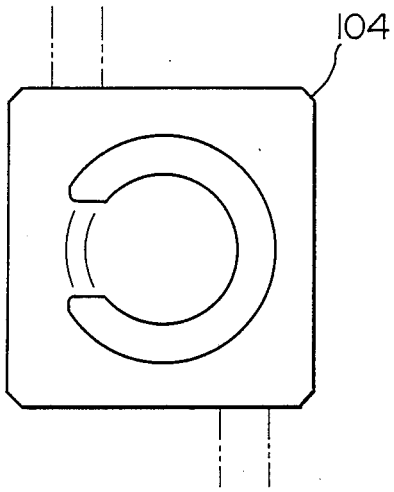
Figure 16A:
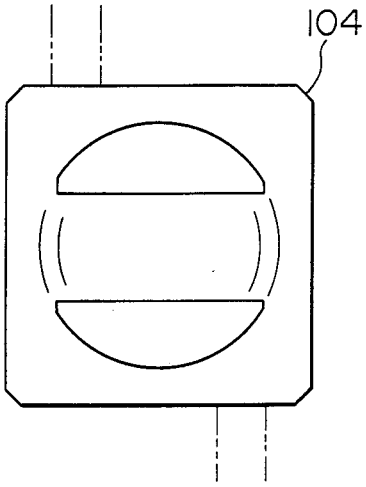
FIGS. 16A and 16B are a plan view and a side sectional view respectively of the thin conductive plate according to a further embodiment.
Figure 15B:
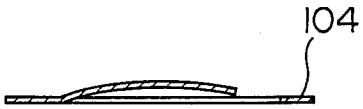
Figure 16B:
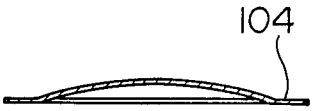

The thin conductive plate 104 may alternatively be formed in a shape as shown in FIGS. 15A and 15B or in FIGS. 16A and 16B. If the plate is formed in such a shape, fabrication thereof becomes easier than the belleville spring shown in FIG. 14B, thus reducing the production cost. In this case, each contact is kept sealed by covering the whole top surface of the thin conductive plate 104 with a single sheet of a heatresistive film 106. At the same time, the outer edge portion of the heat-resistive film 106 is fixedly secured between the top surface of the thin conductive plate 104 and the bottom surface of the annular member 105.

Figure 17A:
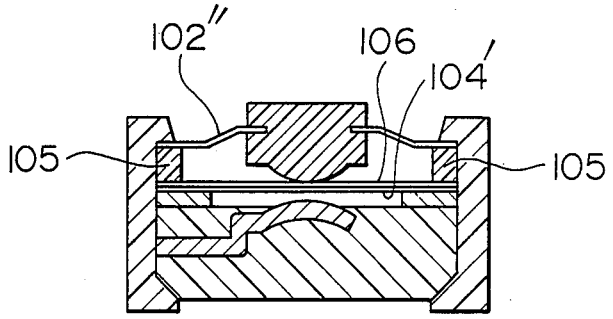
FIGS. 17A and 17B are a side sectional view of the same push switch and a plan view of the thin conductive plate respectively according to a still further embodiment.

A push switch according to still another embodiment of the present invention is shown in FIG. 17A.

Figure 17B:
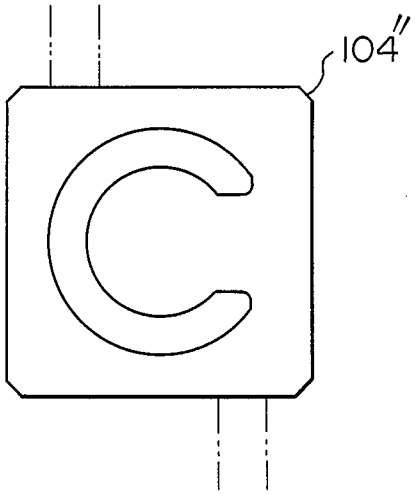

A thin conductive plate 104' shown in FIG. 17A is formed in a tabular cantilever spring as shown in FIG. 17B and has no function to reverse. As a result, the durability is improved without any increase in internal stress. In FIG. 17A, a spring member 102" is formed in the shape of a spring plate like the embodiment of FIG. 14A, and in order to eliminate the inconveniences which otherwise might be caused by exposing the thin conductive plate 104', the outer surface of the thin conductive plate 104' is covered by a heat-resistive film 106. This heat-resistive film 106 is constructed the same way as the one described above.

Figure 5:
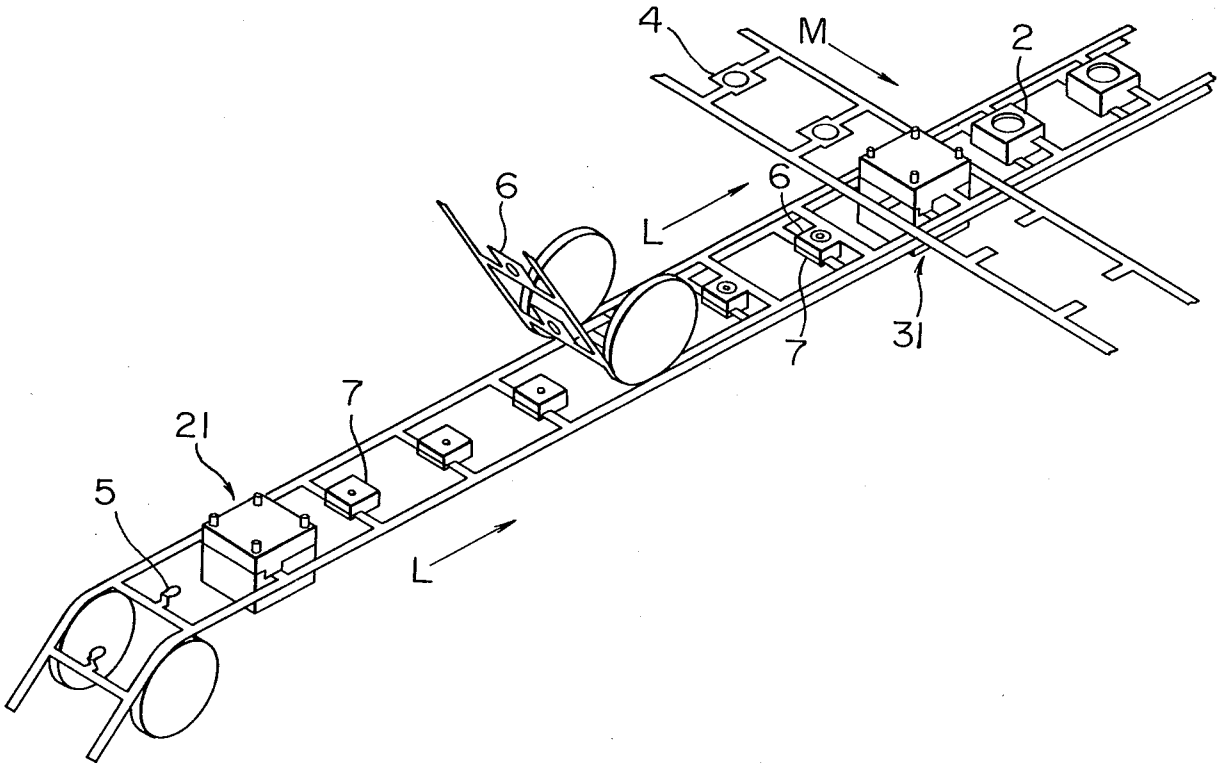
FIG. 5 is a perspective view showing an outline of the essential parts of a production line for explaining a method of fabricating the push switch according to the present invention.
Figure 18:
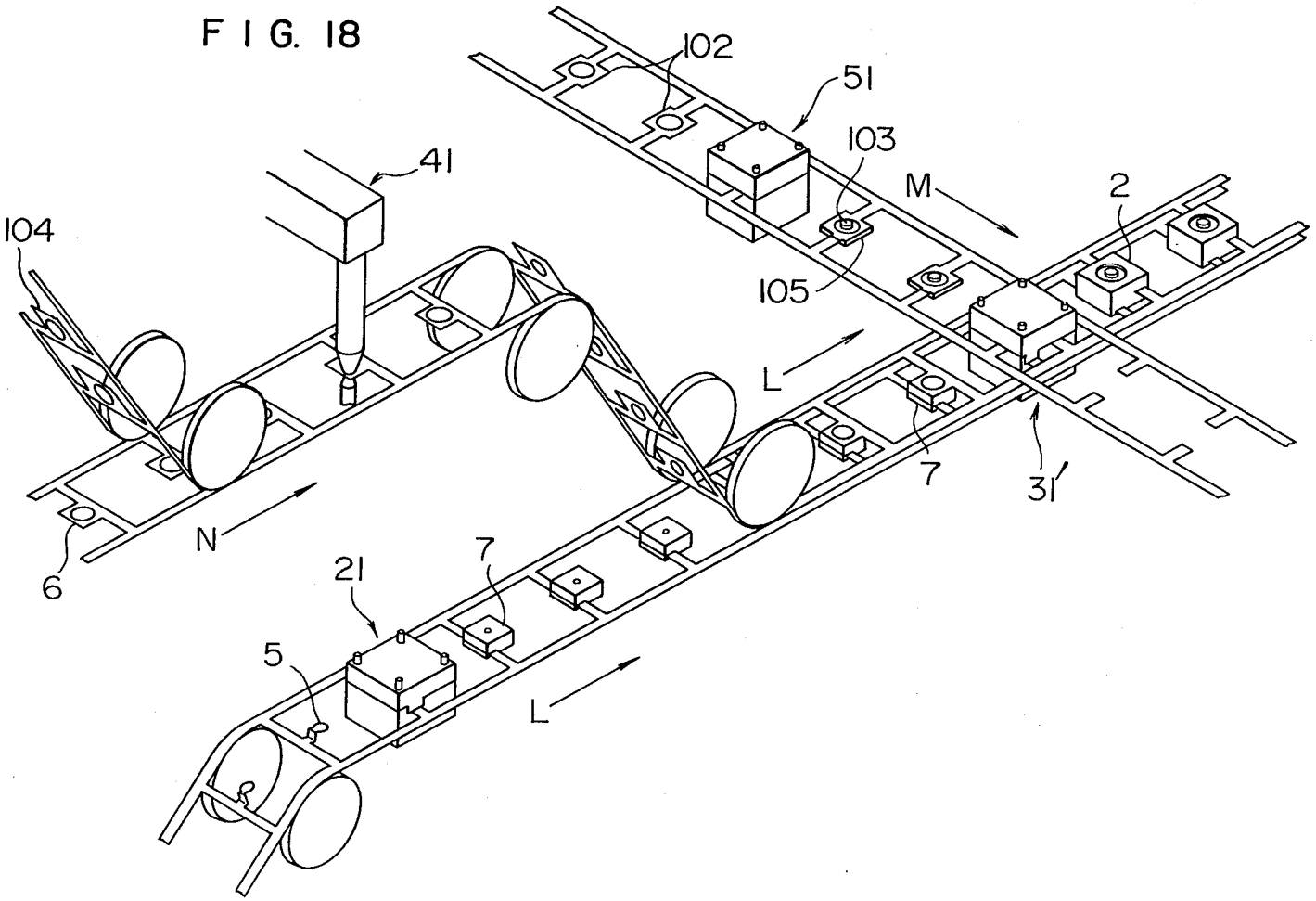
FIG. 18 is a perspective view showing an outline of the essential parts of a production line for explaining a method of fabricating the push switch shown in FIG. 11.

Now, explanation will be made of a method of fabricating the push switch 100. The method of fabricating push switch 100 is similar to that for the push switch 1 described above with reference to FIGS. 5 to 9. In FIG. 18, the component elements identical to those shown in FIG. 5 are denoted by the same reference numerals as those in FIG. 5.

As shown in FIG. 18, a multiplicity of central contacts 5, peripheral contacts 6, thin conductive plates 104 and spring members 102 are formed by being coupled in sequence by press work. In the production line, the central contacts 5 are fed in the direction L. During this feeding, the central contacts 5 are subjected to a first insert molding process by an insert molder 21, whereby contact support members 7 are formed.

The peripheral contacts 6, together with the thin conductive plates 104, are fed in the direction of arrow N parallel to the direction of arrow L. The thin conductive plates 104 and the peripheral contacts 6 are spot-welded by a spot welder 41 and integrated with each other into a pair.

The thin conductive plate 104 and the peripheral contact 6 thus connected by spot welding are set on the top of the contact support member 7. The contact support member 7 supporting the thin conductive plate 104, peripheral contact 6 and the central contact 5 is fed in the direction of arrow L.

The spring member 102, on the other hand, is fed in the direction indicated by arrow M perpendicular to the direction of arrow L. During this feed, an operating button 103 and an annular member 105 are formed by a resin molder 51. In this way, the spring member 102 carrying the operating button 103 and the annular member 105 is fed in the direction indicated by arrow M, and at the position of the insert molder 31', set on the top of the thin conductive plate 104 fed in the direction L together with the contact support member 7. Under this condition, the contact support member 7, peripheral contact 6, thin conductive plate 104 and the spring member 102 are insert-molded by the insert molder 31', whereby a case 2 is formed. In the second insert molding process, such couplers as the spring member 102 are cut off, and therefore the case 2 is fed in the direction indicated by arrow L.

Now, each step of the above-mentioned method of fabrication will be explained, except for the first insert molding process which was explained as a part of the method of fabricating the push switch 1.

Figure 8:
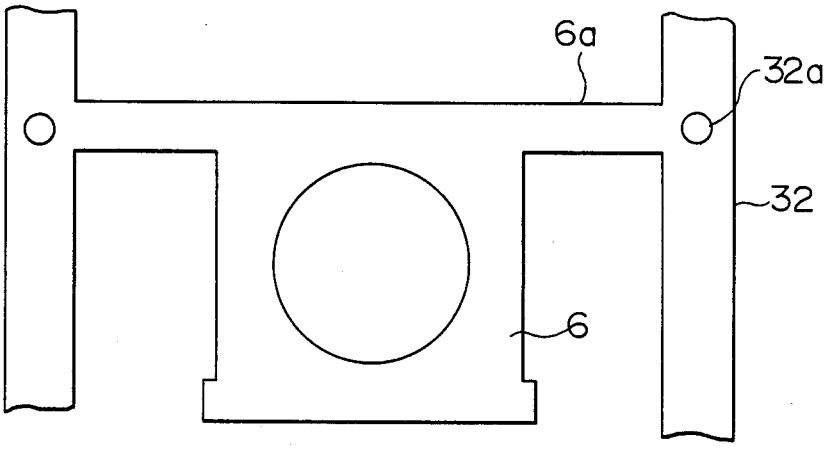
FIG. 8 is a plan view showing a peripheral contact used for a second insert molding process.
Figure 9:
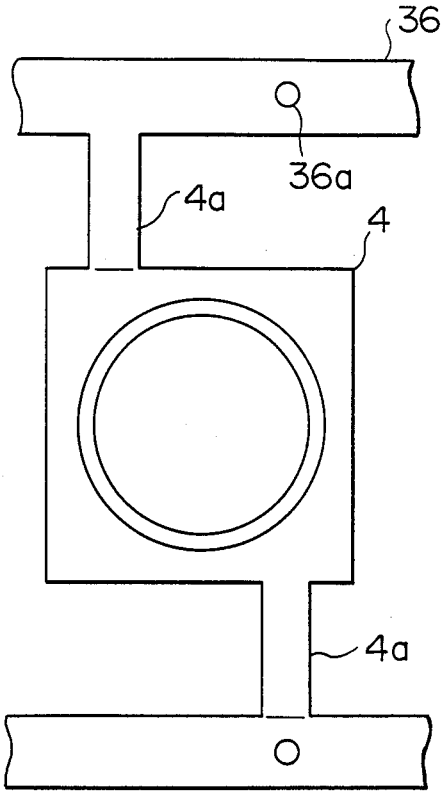
FIG. 9 is a plan view of a belleville spring used for the second insert molding process.
Figure 19A:
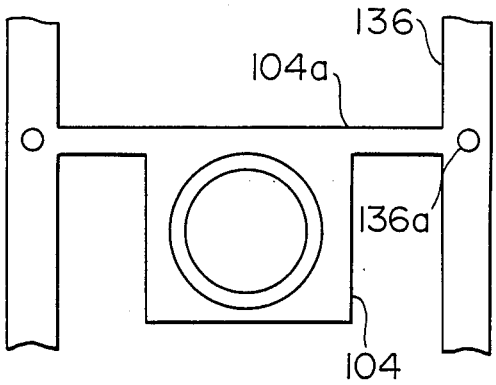
FIG. 19A is a plan view of a thin conductive plate in a spot welding process.
Figure 19B:
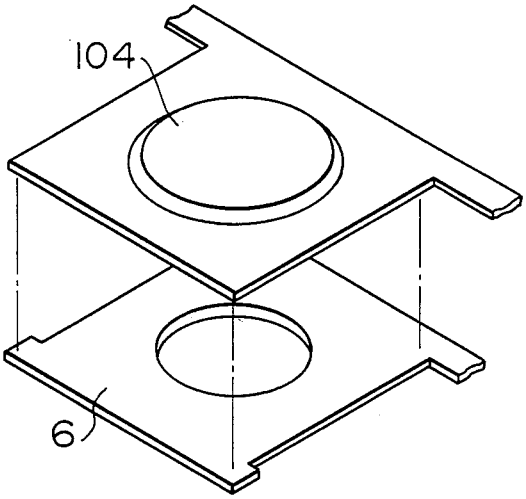
FIG. 19B is a perspective view showing a mounting condition for the spot welding process.

The spot welding process will be first explained. As shown in FIGS. 8 and 19A, the peripheral contact 6 and the thin conductive plate 104 are supported on the guides 32, 136 through couplers 6*a*, 104*a*. Each of the guides 32, 136 has pin holes 32*a*, 136*a* arranged equidistantly therein. These pin holes 32*a*, 136*a* are fitted on pins formed along the periphery of a roller during feed. The peripheral contact 6 and the thin conductive plate 104 are laid one on the other in the manner shown in FIG. 19B at least before the second insert molding process described later and spot-welded at the four corners thereof. As a result, the thin conductive plate 104 is integrated with the central contact 6 as it is disposed on the peripheral contact 6 with the bottom of the outer edge portion of the thin conductive plate 104 in contact with the whole periphery of the top of the peripheral contact 6.

As an alternative, the coupler 104*a* of the thin conductive plate 104 is displaced from the coupler 6*a* of the peripheral contact 6, and the coupler 104*a* of the thin conductive plate 104 is cut off immediately after spot welding.

The step of processing the spring member will now be explained.

Figure 20:
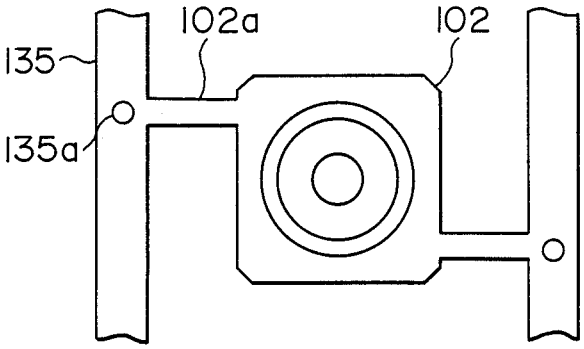
FIG. 20 is a plan view of a spring member in a spring member processing step.

In the production line of the push switch 100, the spring member 102 is formed with the operating button 103 and the annular member 105 at least before the second insert molding process mentioned later. As shown in FIG. 20, the spring member 102 is formed by press work, and is supported on the guide 135 through the coupler 102*a*. The guide 135 has a plurality of equidistantly arranged pin holes 135*a* formed therein. These pin holes 135 are fitted on the pins formed along the periphery of rollers while being fed.

Figure 21A:
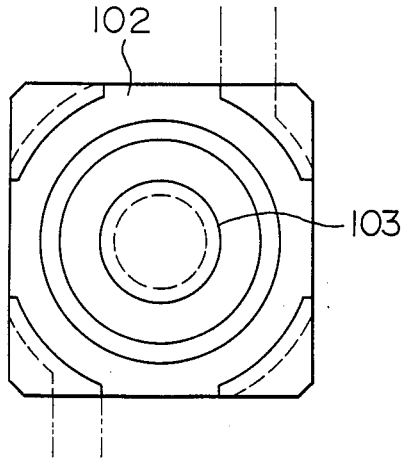
FIGS. 21A, 21B and 21C are a plan view, a front sectional view and a bottom view respectively of a spring member molded by the spring member processing step.
Figure 21B:
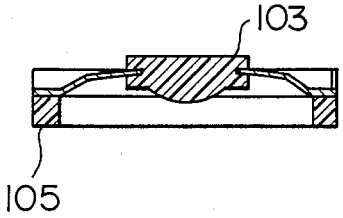
Figure 21C:
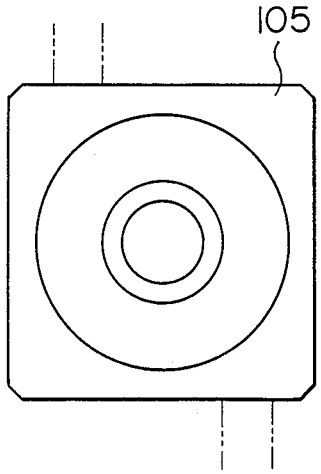
Figure 22:
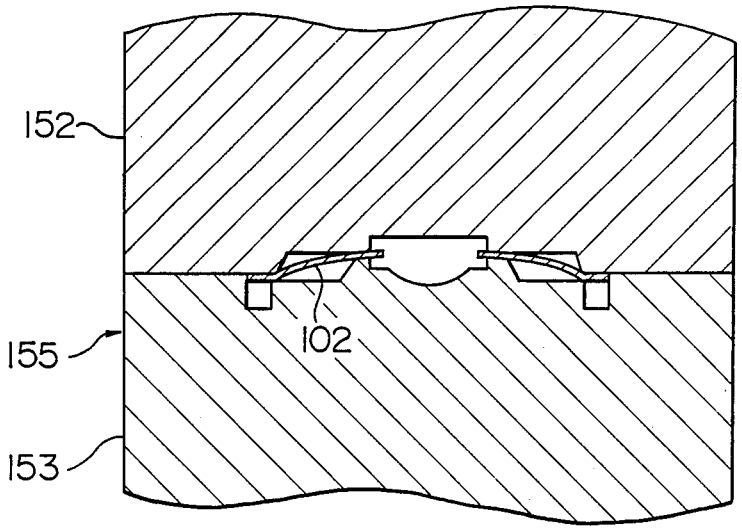
FIG. 22 is a front sectional view showing a die used for the spring member processing step.

The spring member is processed by resin molding with a die 155 shown in FIG. 22. The die 155 includes an upper die unit 152 and a lower die unit 153. Before the spring member is processed, the upper die unit 152 and the lower die unit 153 are separated, and a spring member 102 is held therebetween. When the upper die unit 152 and the lower die unit 153 are combined with each other, a space shown in FIG. 22 is formed within the die 155. This space is supplied with resin from a supply unit not shown. As a result of this spring member process, the operating button 103 and the annular member 105 are formed on the spring member 102 as shown in FIGS. 21A, 21B and 21C.

Now, the second insert molding process will be explained.

The contact support member, the combined thin conductive plate 104 and the peripheral contact 6 and the spring member 102 formed by the first insert molding, spot welding and the spring member process are integrated at the position of the second insert molder 31'. Specifically, the combined thin conductive plate 104 and the peripheral contact 6 and the spring member 102 formed with the operating button 103 and the annular member 105 are placed on the top of the contact support member 7.

Figure 23:
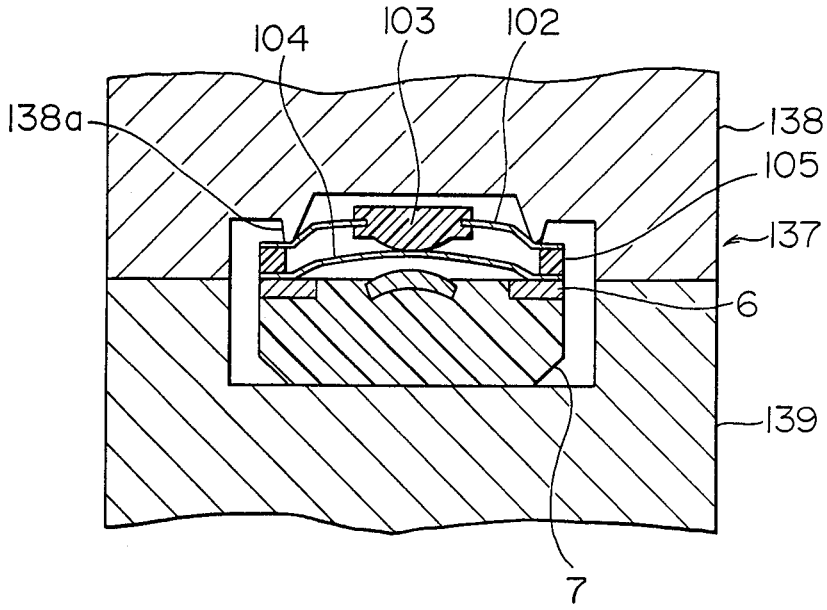
FIG. 23 is a front sectional view of a die used for the second insert molding process.
Figure 24:
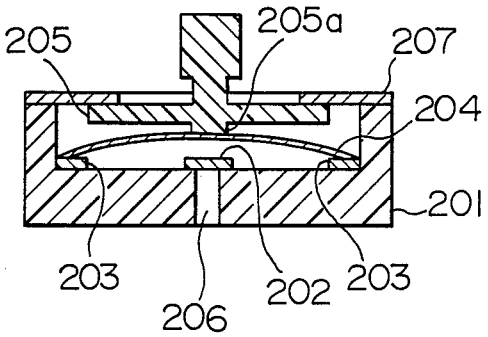
F I G. 24 PRIOR ART
FIG. 24 is a front sectional view showing a conventional push switch.

The insert molder 31' has a die 137 shown in FIG. 23. The die 137 is comprised of an upper die unit 138 and a lower die unit 139, into which the die 137 is separated before the start of the second insert molding work. When the contact support member 7, peripheral contact 6, thin conductive plate 104 and the spring member 102 are fed between the upper die unit 138 and the lower die unit 139, the upper and lower die units 138 and 139 are combined. Then, a space shown in FIG. 23 is formed within the die 137. A protrusion 138*a* formed in the upper die unit 138 in this space is in contact with the whole periphery of the spring member 102. An annular member 105 formed on the bottom of the spring member 102, on the other hand, is in contact with the whole outer periphery of the thin conductive plate 104. As a consequence, the interior of the annular member 105 and the protrusion 138a are completely sealed. When resin is supplied only to the exterior of the protrusion 138*a* and the annular member 105 from a supply unit, therefore, the supplied resin is prevented from intruding the interior of the protrusion 138*a* and the annular member 105. In this manner, the case 2 shown in FIGS. 11, 12A, 12B and 12C is formed in close contact with the sides of the contact support member 7, the sides of the annular member 105 and the top of the outer edge portion of the spring member 102. The die 137 is provided with a cutter not shown, so that when the upper die unit 138 and the lower die unit 139 are combined with each other, the coupler 5*a* of the central contact 5 and the coupler 6*a* of the peripheral contact 6 are cut off into terminals 5*a* and 6*a* respectively, while the coupler 102*a* of the spring member 102 is cut off.

As described above, according to the present embodiment, the thin conductive plate 104 is integrated with the peripheral contact 6 by spot welding before the second insert molding, and therefore, these two parts are accurately kept in contact and in position. Further, although the spring member 102 is fed in a direction perpendicular to the direction of feed of other members, the fact that the coupler of the spring member 102 is cut off in the second insert molding process permits the push switch to be fed in the direction indicated by L that is in the same direction as other members including the central contact after the second insert molding. The spot welding of the thin conductive plate 104 to the peripheral contact 6 may be done without.

In the push button according to the present invention, a spring member fixedly secured with an operating button can be molded integrally on the case, and therefore the whole apparatus become compact and thin. Further, the pressure of the operating button acts also on the spring member as well as on the thin conductive plate, thereby reducing the stress exerted on the thin conductive plate. As a result, the elastic force required of the thin conductive plate is reduced, so that both the click feeling and operability are improved while at the same time reducing the fatigue due to repetitive stress for an improved durability.

In the method of fabricating a push switch according to the present invention, on the other hand, an operating button is contained in the case, and therefore the process of mounting an operating button or a protective member is eliminated in a production line, thus improving the productivity.

We claim:

1. A push switch comprising:

a central contact member and a peripheral contact member, both of said members forming a conductive path; said peripheral contact member having an annular shape and surrounding said central contact member, said members being radially spaced from each other;

an insulating contact support member for supporting said central and peripheral contact members;

a first conductive belleville spring having a central portion adapted to contact said central contact member and an outer edge portion in contact with a top surface of said peripheral contact member;

a second belleville spring having an outer edge portion, provided with an insulating annular member and an insulating, operating button fixedly secured to said central portion of said second belleville spring, said second belleville spring being separated from said first belleville spring through said insulating annular member;

at least one air chamber formed within said insulating contact support member, said air chamber at a bottom part being defined by a thin, flexible bottom wall of said contact support member, with at least one hole provided in said contact support member on the side opposite said thin, flexible wall;

a sealed space formed below an inner side of said first belleville spring facing said central contact member and being open into said air chamber; and an insulating case in close contact with an outside surface of said contact support member for fixedly securing outer edge portions of said first and second belleville springs and said peripheral contact member between said case and a top surface of said contact support member along a whole periphery thereof, such that said central and peripheral contact members are surrounded by a completely sealed space.

2. A push switch according to claim 1, wherein said second belleville spring is conductive and includes a grounding terminal having an edge portion exposed outside of said case.

3. A push switch according to claim 1, wherein said second belleville spring forms a cover fixedly secured along the entire periphery thereof over said first belleville spring.

4. A push switch comprising:

a central contact member and a peripheral contact member, said peripheral contact member having an annular shape and surrounding said central contact member, said members being radially spaced from each other;

an insulating contact support member for supporting said central and peripheral contact members;

a conductive belleville spring extending above said central contact member and having an upwardly-shaped central portion and an outer edge portion positioned over a top surface and along the entire periphery of said peripheral contact member;

an insulating case in close contact with an outer surface of said contact support member for fixedly and sealingly securing said outer edge portion of said belleville spring and said peripheral contact member between said case and a top surface of said contact support member along an entire periphery thereof, such as to prevent foreign matters from entering between said peripheral contact and said outer edge of said belleville spring, and to sealingly close a space formed under an inner side of said belleville spring facing said central contact member, such that a conductive path is formed by said central and peripheral contact members through said belleville spring and is completely sealed off; and at least one air chamber formed in said insulating contact support member, said air chamber having a top portion in communication with said space formed on said inner side of said belleville spring, said at least one air chamber at a bottom part thereof being defined by a thin, flexible bottom wall of said contact support member with at least one recess being provided in said contact support member on the opposite side of said thin, flexible bottom wall.

5. A push switch according to claim 4, wherein said insulating contact support member includes a plurality of said air chambers.

6. A push switch according to claim 5, wherein said central and peripheral contact members are supported in said insulating contact support member with upper surfaces at substantially the same level.

7. A push switch according to claim 5, wherein said air chambers are formed as inwardly extending recesses in said contact support member.

* * * * *

UNITED STATES PATENT AND TRADEMARK OFFICE

CERTIFICATE OF CORRECTION

PATENT NO. : 4,843,197

DATED : June 27, 1989

INVENTOR(S) : Hisanao Kojima & Hirabayashi

It is certified that error appears in the above-identified patent and that said Letters Patent is hereby corrected as shown below:

On the title page and col. 1, lines 2-3, change "(54)" BUSH SWITCH AND METHOD OF PRODUCTION THEREOF to --(54) PUSH SWITCH AND METHOD OF PRODUCTION THEREOF--.

On the title page, change "(75)" Inventors: Hisano" to --(75) Inventors: Hisanao--.

Signed and Sealed this

Twenty-second Day of May, 1990

*Attest:*

HARRY F. MANBECK, JR.

*Attesting Officer*

*Commissioner of Patents and Trademarks*